US012187468B2

(12) United States Patent
Liang et al.

(10) Patent No.: US 12,187,468 B2
(45) Date of Patent: Jan. 7, 2025

(54) MATTRESS PACKAGING DEVICE AND PACKAGING METHOD

(71) Applicant: Guangzhou Lianrou Machinery & Equipment Co., Ltd., Guangdong (CN)

(72) Inventors: Jie Liang, Guangdong (CN); Zhiming Tan, Guangdong (CN); Zhiliang Tan, Guangdong (CN)

(73) Assignee: Guangzhou Lianrou Machinery & Equipment Co., Ltd., Guangzhou (CN)

( * ) Notice: Subject to any disclaimer, the term of this patent is extended or adjusted under 35 U.S.C. 154(b) by 0 days.

(21) Appl. No.: 17/998,978

(22) PCT Filed: Jul. 13, 2022

(86) PCT No.: PCT/CN2022/105355
§ 371 (c)(1),
(2) Date: Nov. 16, 2022

(87) PCT Pub. No.: WO2023/065734
PCT Pub. Date: Apr. 27, 2023

(65) Prior Publication Data

US 2024/0253833 A1 Aug. 1, 2024

(30) Foreign Application Priority Data

Oct. 19, 2021 (CN) ..... 202111214753.9

(51) Int. Cl.
*B65B 11/08* (2006.01)
*B65B 11/12* (2006.01)
(Continued)

(52) U.S. Cl.
CPC ..... *B65B 11/12* (2013.01); *B65B 11/08* (2013.01); *B65B 11/16* (2013.01); *B65B 11/48* (2013.01); *B65B 35/243* (2013.01); *B65B 41/16* (2013.01); *B65B 51/06* (2013.01); *B65B 57/12* (2013.01); *B65B 61/06* (2013.01)

(58) Field of Classification Search
CPC ..... B65B 11/02; B65B 11/08; B65B 11/12; B65B 11/16; B65B 11/48; B65B 35/243;
(Continued)

(56) References Cited

U.S. PATENT DOCUMENTS 996,187 A * 6/1911 Wilson ..... B65B 11/12 53/209
2,486,892 A * 1/1949 Sumida ..... B65B 11/12 53/233

(Continued)

FOREIGN PATENT DOCUMENTS

CN 104290946 A 1/2015
CN 110239755 A 9/2019

(Continued)

OTHER PUBLICATIONS

First Action issued for China application No. CN2021112147539, dated Sep. 29, 2022. China application No. CN2021112147539 is claimed as foreign priority of the subject application.

(Continued)

*Primary Examiner* — Stephen F. Gerrity
(74) *Attorney, Agent, or Firm* — Epstein Drangel LLP; Robert L. Epstein

(57) ABSTRACT

A mattress packaging device includes a first packaging device and a second packaging device, where the first packaging device includes a first folding and vertical sealing mechanism and two corner sealing mechanisms, the first folding and vertical sealing mechanism is configured for folding and vertically sealing a packaging material opening at the end of a mattress, and the corner sealing mechanisms are configured for folding and transversely sealing front corner and rear corner of packaging material on two sides of the mattress; the second packaging device includes two second folding and vertical sealing mechanisms and two first transverse sealing mechanisms, the second folding and (Continued)

vertical sealing mechanisms are configured for folding and vertically sealing the packaging material on two sides of the mattress, and the two first transverse sealing mechanisms are configured for transversely sealing the packaging material on two sides of the mattress.

18 Claims, 9 Drawing Sheets

(51) Int. Cl.

| | |
|---|---|
| ***B65B 11/16*** | (2006.01) |
| ***B65B 11/48*** | (2006.01) |
| ***B65B 35/24*** | (2006.01) |
| ***B65B 41/16*** | (2006.01) |
| ***B65B 51/06*** | (2006.01) |
| ***B65B 57/12*** | (2006.01) |
| ***B65B 61/06*** | (2006.01) |

(58) Field of Classification Search
CPC ..... B65B 41/16; B65B 51/06; B65B 57/12; B65B 61/06
USPC ..... 53/466, 228–230, 372.6, 66, 389.3
See application file for complete search history.

(56) References Cited

U.S. PATENT DOCUMENTS

| | | | | | |
|---|---|---|---|---|---|
| 3,507,091 | A | * | 4/1970 | Mizell et al. | B65B 11/12 53/230 |
| 3,564,810 | A | * | 2/1971 | Faletti et al. | B65B 11/10 53/466 |
| 3,685,253 | A | * | 8/1972 | Herrell et al. | B65B 11/02 53/228 |
| 3,869,846 | A | * | 3/1975 | Timmerbeil | B65B 49/08 53/230 |

FOREIGN PATENT DOCUMENTS

| | | | | | |
|---|---|---|---|---|---|
| CN | 110481875 | A | | 11/2019 | |
| CN | 210260222 | U | | 4/2020 | |
| CN | 111169709 | A | | 5/2020 | |
| CN | 211139858 | U | | 7/2020 | |
| CN | 111717492 | A | | 9/2020 | |
| CN | 112389702 | A | | 2/2021 | |
| CN | 112520128 | A | | 3/2021 | |
| CN | 212891082 | U | | 4/2021 | |
| CN | 214029271 | U | * | 8/2021 | B65B 11/02 |
| CN | 114013745 | A | | 2/2022 | |
| DE | 1170859 | B | | 5/1964 | |
| DE | 1586015 | A1 | * | 5/1970 | B65B 11/12 |
| JP | 01226512 | A | * | 9/1989 | |
| JP | 2000211604 | A | | 8/2000 | |

OTHER PUBLICATIONS

International Search Report and Written Opinion of the International Search Authority issued Sep. 22, 2022 for Continuity Application No. PCT/CN2022/105355.

* cited by examiner

MATTRESS PACKAGING DEVICE AND PACKAGING METHOD

CROSS-REFERENCE TO RELATED APPLICATION

This application is filed on the basis of Chinese patent application No. 2021112147539 filed Oct. 19, 2021, and claims priority of the Chinese patent application, the entire contents of which are incorporated herein by reference.

TECHNICAL FIELD

The present disclosure relates to the field of mattress production and manufacturing, in particular to a mattress packaging device and a packaging method.

BACKGROUND

In order to facilitate transportation and protect mattresses, it's necessary to package the mattresses in the processes of mattress production, manufacturing and transportation, generally by manual packaging or by using mattress packaging machines.

In the related art, an upper layer of kraft paper and a lower layer of kraft paper need to be subjected to thermal welding during package of the mattress packaging machine, the redundant kraft paper is cut off after thermal welding, and then a protrusion formed by welding at each opening is firstly transversely pasted, vertically pasted and then transversely pasted by using an adhesive tape, which makes the manufacturing process complicated, and the cut kraft paper is also difficult to be reused. Moreover, it's necessary to use the kraft paper with good thermal weldability to ensure the quality of welding. However, the cost of the kraft paper with good thermal weldability is high and the waste of the kraft paper is relatively large, which also increases the cost of raw materials.

SUMMARY

The present disclosure aims to solve at least one of the technical problems in the existing technology, and provides a mattress packaging device and a packaging method, which simplify the packaging process.

In a first aspect, embodiments of the present disclosure provide a mattress packaging device, including:

a first packaging device including a first folding and vertical sealing mechanism and two corner sealing mechanisms, the first packaging device being provided with a first station for accommodating a mattress, the first folding and vertical sealing mechanism being arranged on a rear side of the first station and configured for folding and vertically sealing a packaging material opening at an end of the mattress, and the two corner sealing mechanisms being arranged respectively on a left side and a right side of the first station and configured for folding and transversely sealing a front corner and/or a rear corner of packaging material on two sides of the mattress; and a second packaging device including two second folding and vertical sealing mechanisms and two first transverse sealing mechanisms, arranged downstream of the first packaging device, and provided with a second station for accommodating the mattress, the two second folding and vertical sealing mechanisms being arranged on a left side and a right side of the second station and configured for folding and vertically sealing the packaging material on two sides of the mattress, and the two first transverse sealing mechanisms being arranged on the left side and the right side of the second station and configured for transversely sealing the packaging material on two sides of the mattress.

The mattress packaging device at least has the following beneficial effects. The packaging material is folded in half to wrap the mattress, and an opening is formed at the end of the mattress. The mattress is conveyed into the first packaging device, the mattress is placed on the first station, the packaging material opening at the end of the mattress is folded and vertically sealed by the first folding and vertical sealing mechanism, and the front corner and the rear corner of the packaging material on two sides of the mattress are folded and transversely sealed by the two corner sealing mechanisms. Then the mattress is conveyed into the second packaging device, the mattress is placed on the second station, the packaging material on two sides of the mattress are folded and vertically sealed by the second folding and vertical sealing mechanism, and the packaging material on two sides of the mattress are transversely sealed by the two first transverse sealing mechanisms. In this way, vertical sealing of the packaging material at the end of the mattress and sealing of the front corner and the rear corner of the packaging material on two sides of the mattress are realized by the first packaging device, and vertical sealing and transverse sealing of the packaging material on two sides of the mattress are realized by the second packaging device, so that the packaging process is simplified, and sealing and packaging are done only with adhesive tapes, without thermal welding, thereby reducing the cost.

In some embodiments, a conveying mechanism is arranged on the first station and/or the second station, and includes a first conveying assembly and a second conveying assembly which are oppositely arranged up and down, the first conveying assembly is configured for pressing the mattress conveyed on the second conveying assembly.

In some embodiments, the first conveying assembly and/or the second conveying assembly may be moved up and down to adjust the distance between the first conveying assembly and the second conveying assembly.

In some embodiments, a conveying roller group is arranged on the rear side of the first station, and includes two groups of conveying rollers which are oppositely arranged up and down, a space for the mattress to pass through is formed between the two groups of conveying rollers, and the two groups of conveying rollers are configured for clamping the mattress after the mattress moves forward to a predetermined position.

In some embodiments, one or two groups of the conveying rollers is movable up and down, and one or two groups of the conveying rollers are connected with a power source.

In some embodiments, the corner sealing mechanism includes two first sealing machine arranged in a front-back direction, the first sealing machine on a front side is configured for attaching the front corner of the packaging material to the mattress when the mattress moves forward and sealing the front corner, and the first sealing machine on a rear side is configured for attaching the rear corner of the packaging material to the mattress when the mattress moves backward reversely and sealing the rear corner.

In some embodiments, the corner sealing mechanism includes a first sealing machine for attaching the front corner of the packaging material to the mattress when the mattress moves forward and sealing the front corner, and for attaching the rear corner of the packaging material to the mattress when the mattress moves backward reversely and sealing the rear corner.

In some embodiments, the first folding and vertical sealing mechanism and the second folding and vertical sealing mechanism both include a vertical sealing assembly and a folding assembly which are oppositely arranged up and down, the folding assembly is movable up and down to push a lower edge or an upper edge of the packaging material to be attached to the mattress, and the vertical sealing assembly includes a plurality of second sealing machines, and is movable up and down to push the upper edge or the lower edge of the packaging material to be attached to the mattress and vertically seal the packaging material.

In some embodiments, the folding assembly includes a pushing plate and a pressing plate, a plurality of first gaps are formed in the pressing plate at intervals, a plurality of second gaps are formed in the pushing plate at intervals, the first gaps and the second gaps are arranged in a staggered manner to form a structure in which the pushing plate and the pressing plate are able to be embedded into each other, the pushing plate and the pressing plate are movable up and down relative to each other, the pushing plate is configured for pushing the upper edge or the lower edge of the packaging material to be attached to the mattress and then being separated from the mattress, the pressing plate is configured for fixing positions of the upper edge or the lower edge after the upper edge or the lower edge of the packaging material is attached to the mattress, and the second sealing machines are arranged in a vertical direction of the first gaps.

In some embodiments, a smooth protrusion for contact with the mattress is arranged on one side of an upper end of the pushing plate.

In some embodiments, the first transverse sealing mechanism includes a third sealing machine configured for transversely sealing the packaging material on two sides of the mattress when the mattress moves forward.

In some embodiments, the second packaging device further includes a second transverse sealing mechanism, the second transverse sealing mechanism is arranged on a rear side of the second station and includes a fourth sealing machine movable left and right to transversely seal the packaging material at an end of the mattress.

In some embodiments, the second packaging device includes a pressing member, the pressing member is arranged on a left side and a right side above the second station and movable up and down, and the pressing member is configured for pressing the mattress to keep the mattress fixed.

In some embodiments, the mattress packaging device further includes a feeding device arranged upstream of the first packaging device, the feeding device is configured for pulling a roll of the packaging material to place the packaging material in front of the mattress.

In some embodiments, the feeding device includes two positioning members which are oppositely arranged, the two positioning members are movable in opposite directions to place the mattress at a centered position, and an induction assembly for detecting a left-right width of the mattress is installed on each positioning member.

In some embodiments, the feeding device includes a pulling assembly and a cutting assembly which are oppositely arranged up and down, the pulling assembly is movable up and down and configured for clamping and pulling the packaging material to vertically place the packaging material in front of the mattress, and the cutting assembly is configured for clamping and cutting the packaging material.

In some embodiments, the cutting assembly includes a cutter and two clamping members capable of clamping relative to each other, the two clamping members each define a groove opposite to each other, and a space for the cutter to move and cut the packaging material is formed between the grooves of the two clamping members.

In some embodiments, the feeding device includes a pre-pulling assembly, the pre-pulling assembly includes at least one push-pull member, and the push-pull member is movable in a front-back direction to push and pull the packaging material to make the packaging material form a length matched with a length of the mattress in advance.

In some embodiments, one push-pull member is provided, is arranged at an inlet of the mattress, and pushes the packaging material forward to make the packaging material form a length matched with that of the mattress.

In some embodiments, two push-pull members are provided, wherein one push-pull member is arranged at an inlet of the mattress and movable forward, the other one is arranged above the inlet of the mattress and movable backward, and the two push-pull members move cooperatively to enable the packaging material to form a length matched with that of the mattress.

In a second aspect, embodiments of the present disclosure provide mattress packaging method for packaging a mattress using the mattress packaging device in the first aspect, including:

- placing a packaging material in front of the mattress;
- moving the mattress forward to enable the packaging material to wrap the mattress, wherein a packaging material opening is formed at an end of the mattress;
- conveying the mattress into the first packaging device, placing the mattress on the first station, and folding and vertically sealing the packaging material opening at the end of the mattress by the first folding and vertical sealing mechanism;
- folding and transversely sealing the front corner and the rear corner of the packaging material on two sides of the mattress by the two corner sealing mechanisms;
- conveying the mattress into the second packaging device, placing the mattress on the second station, and folding and vertically sealing the packaging material on two sides of the mattress by the second folding and vertical sealing mechanism;
- transversely sealing the packaging material at the end of the mattress; and
- transversely sealing the packaging material on two sides of the mattress by the two first transverse sealing mechanisms.

In some embodiments, margins of the packaging material are reserved respectively at the end, a left side and a right side of the mattress, and the margins are less than or equal to a thickness of the mattress.

In some embodiments, positions of the two corner sealing mechanisms are kept fixed in the front-back direction, the mattress moves forward to seal the front corner of the packaging material on two sides, and the mattress moves backward to seal the rear corner of the packaging material on two sides.

In some embodiments, the position of the first transverse sealing mechanism is kept fixed in the front-back direction, and the mattress moves forward to transversely seal the two sides of the mattress.

BRIEF DESCRIPTION OF DRAWINGS

The present disclosure will be further described with reference to the accompanying drawings and embodiments.

DETAILED DESCRIPTION

Figure 1:
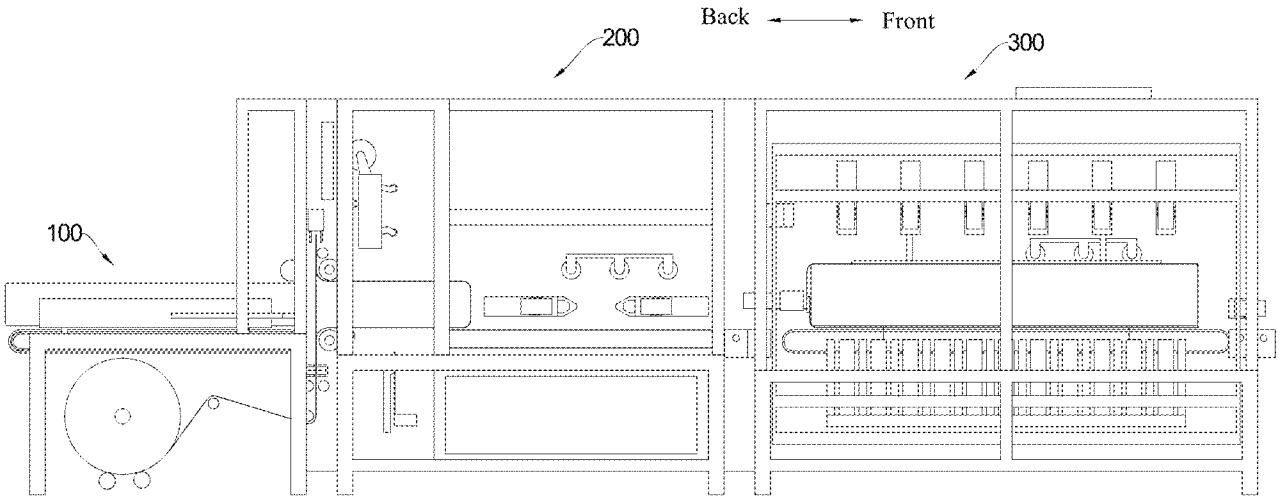
FIG. 1 is a schematic plane view of a mattress packaging device according to an embodiment of the present disclosure, where a roll of raw packaging material is disposed below.

This part will describe the specific embodiments of the present disclosure in detail. The preferred embodiments of the present disclosure are shown in the accompanying drawings. The accompanying drawings are used to supplement the description of the text part of the specification with figures, so that people may intuitively and vividly understand each technical feature and the overall technical solution of the present disclosure, but they should not be construed as limiting the scope of protection of the present disclosure.

In the description of the present disclosure, it should be understood that the orientation or positional relationship involved in the description of the orientation, such as upper, lower, front, rear, left, right, etc., is based on the orientation or positional relationship shown in the accompanying drawings, which is only for the convenience of description of the present disclosure and simplification of the description, and does not indicate or imply that the specified device or element must have a specific orientation, be constructed and operated in a specific orientation, and thus, should not be construed as limiting the present disclosure.

In the description of the present disclosure, the meaning of several is one or more, the meaning of more is two or more, greater than, less than, more than and the like are understood as excluding the number that follows, and above, below, within and the like are construed as including the number that follows. The terms first and second if recited are only for the purpose of distinguishing between technical features, they should be not to be construed as indicating or implying a relative importance or implicitly indicating the number of technical features indicated or implicitly indicating the precedence of technical features indicated.

In the description of the present disclosure, unless otherwise clearly defined, the terms such as arranged, installed, and connected should be interpreted in a broad sense, and those of ordinary skill in the art may reasonably determine the specific meaning of the above terms in the present disclosure in combination with the specific content of the technical solution.

Referring to FIG. 1 to FIG. 16, embodiments of the present disclosure provide a mattress packaging device including a feeding device 100, a first packaging device 200 and a second packaging device 300 which are arranged in sequence from upstream to downstream, where the feeding device 100 pulls a roll of raw packaging material to vertically place the packaging material in front of a mattress, and when the mattress is conveyed forward, the packaging material is folded in half to wrap the mattress, and a packaging material opening is formed at the end (rear side) of the mattress; the first packaging device 200 includes a first folding and vertical sealing mechanism 210 and two corner sealing mechanisms 220, where the first packaging device 200 is provided with a first station for placing the mattress, the mattress is conveyed into the first packaging device and is placed at the first station, the first folding and vertical sealing mechanism 210 is arranged on the rear side of the first station, and is configured for folding and vertically sealing the packaging material opening at the end of the mattress, and the two corner sealing mechanisms 220 are arranged on the left side and the right side of the first station, and are configured for folding and transversely sealing front corner and/or rear corner of the packaging material on two sides of the mattress to enable the front corner and the rear corner to be attached to the left side and the right side of the mattress; and the second packaging device 300 includes two second folding and vertical sealing mechanisms 310 and two first transverse sealing mechanisms 320, the second packaging device 300 is provided with a second station for placing the mattress, the mattress is conveyed into the second packaging device 300 and is placed at the second station, the two second folding and vertical sealing mechanisms 310 are arranged on the left side and the right side of the second station, and are configured for folding and vertically sealing the packaging material on two sides of the mattress, and the two first transverse sealing mechanisms 320 are arranged on the left side and the right side of the second station, and are configured for transversely sealing the packaging material on two sides of the mattress.

In the mattress packaging device according to embodiments of the present disclosure, the packaging material at the end of the mattress is vertically sealed and the front corner and the rear corner of the packaging material on the left side and the right side are sealed by the first packaging device 200, the packaging material on the left side and the right side of the mattress are vertically sealed and transversely sealed by the second packaging device 300, so that the packaging process is simplified, sealing and packaging are done only with adhesive tapes, without thermal welding, and coated kraft paper required by thermal welding is replaced with common kraft paper or plastic film, thereby reducing the cost.

It may be understood that the packaging material may be kraft paper or plastic film or the like for packaging.

Figure 2:
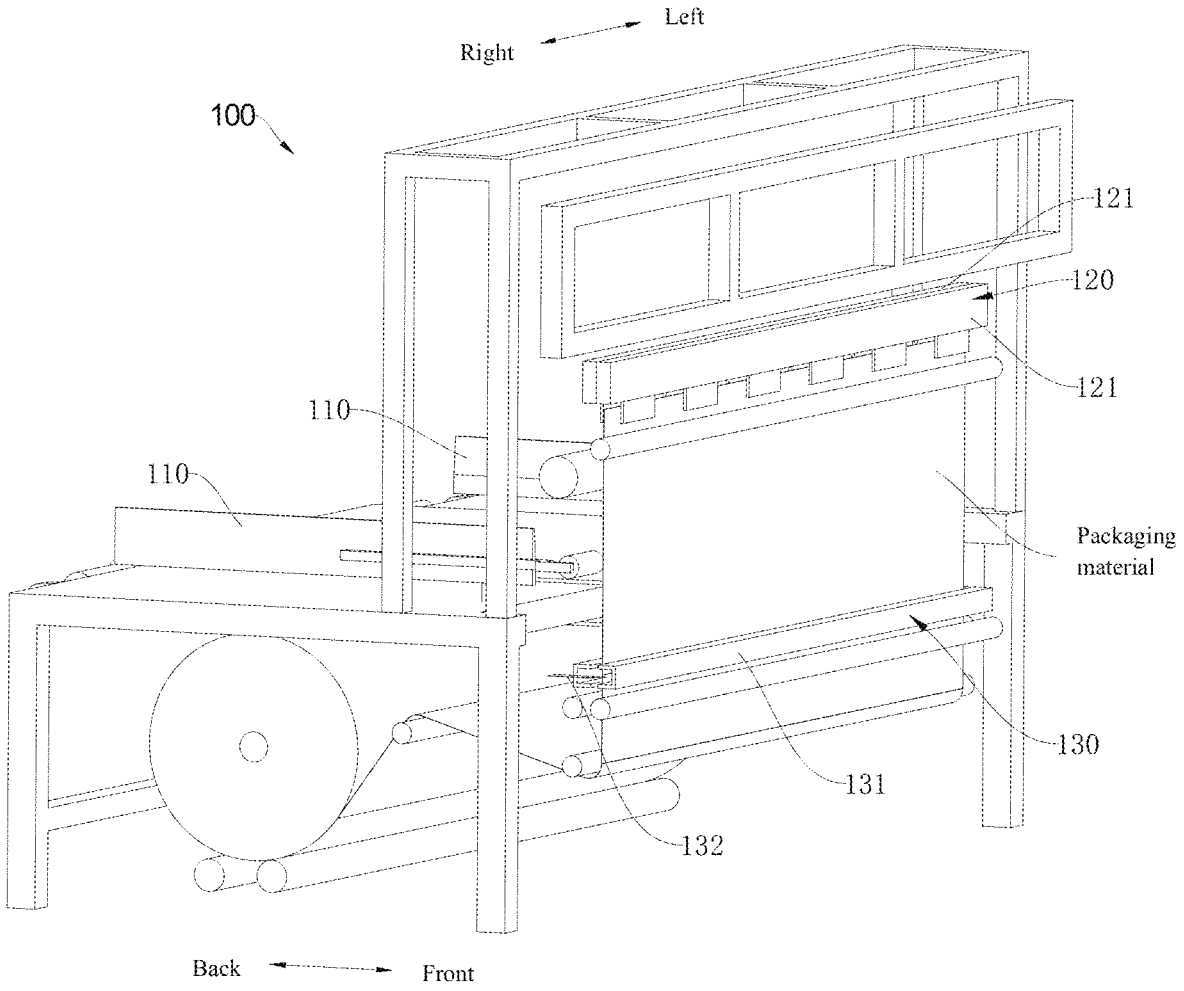
FIG. 2 is a schematic structural diagram of a feeding device according to an embodiment of the present disclosure.

Referring to FIG. 2, in some embodiments, the feeding device 100 includes two positioning members 110 which are oppositely arranged, a space between the two positioning members 110 is used for placing the mattress, the two positioning members 100 may move in opposite directions to place the mattress at the centered position, so that the mattress is located at a middle position of the packaging material in the front, and an induction assembly is installed on each positioning member 110, and is configured for detecting a left-right width of the mattress, providing width data for the first packaging device 200 and the second packaging device 300, and adjusting the relative positions of the corner sealing mechanism 220, the second folding and vertical sealing mechanism 310 and the two first transverse sealing mechanisms 320. Specifically, the induction assembly may be a ranging sensor.

In some embodiments, the feeding device 100 includes a pulling assembly 120 and a cutting assembly 130 which are arranged opposite to each other in a vertical direction, the pulling assembly 120 may move up and down, the pulling assembly 120 clamps and pulls an upper end of the packaging material, so that the packaging material is vertically arranged in front of the mattress, and the cutting assembly 130 is arranged below the pulling assembly 120 for clamping and cutting the packaging material.

Figure 5:
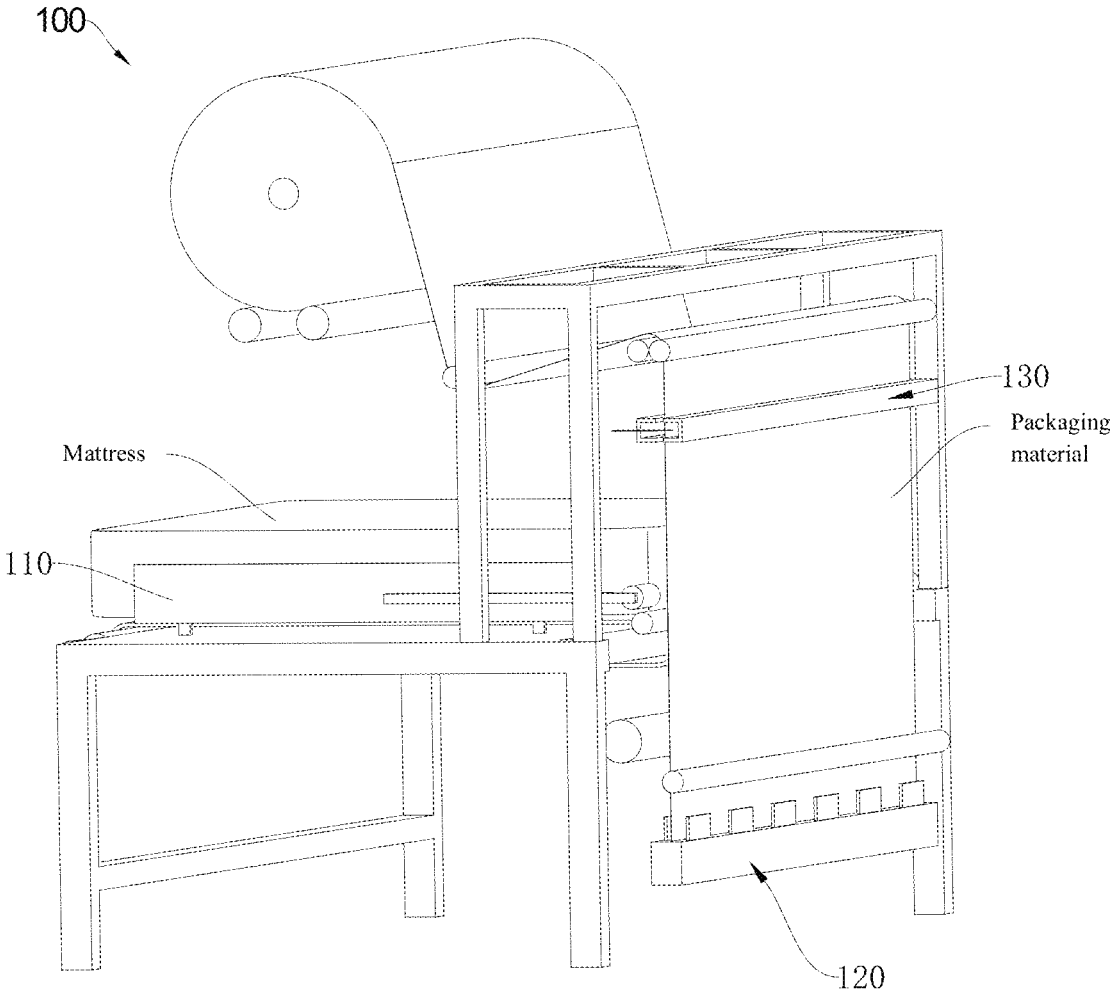
FIG. 5 is a schematic structural diagram of a feeding device according to an embodiment of the present disclosure, where a roll of raw packaging material is arranged above.

It may be understood that the pulling assembly 120 and the cutting assembly 130 may exchange their positions, as shown in FIG. 5.

Figure 4:
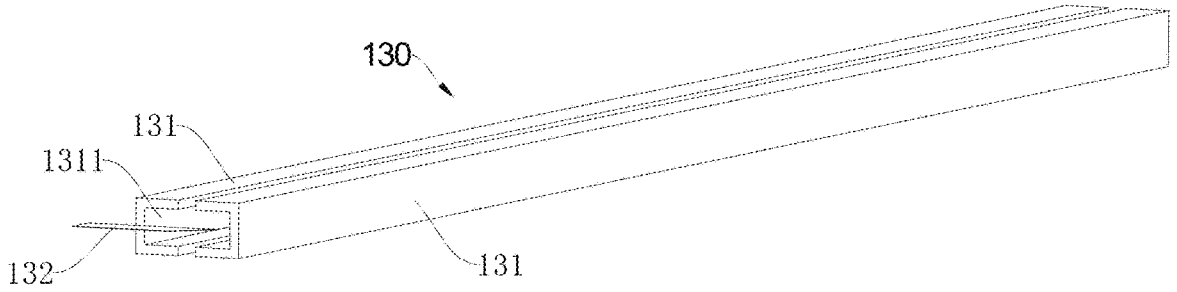
FIG. 4 is a schematic structural diagram of a cutting assembly according to an embodiment of the present disclosure.

Specifically, the pulling assembly 120 includes two clamping plates 121 capable of clamping relative to each other. Referring to FIG. 4, the cutting assembly 130 includes a cutter 132 and two clamping members 131 capable of clamping relative to each other, the two clamping members 131 are transversely arranged from left to right, the two clamping members 131 each define a groove 1311 opposite to each other, and a space for the cutter 132 to move and cut the packaging material is formed between the grooves 1311 of the two clamping members 131. Therefore, the clamping and cutting of the packaging material can be achieved.

Figure 3:
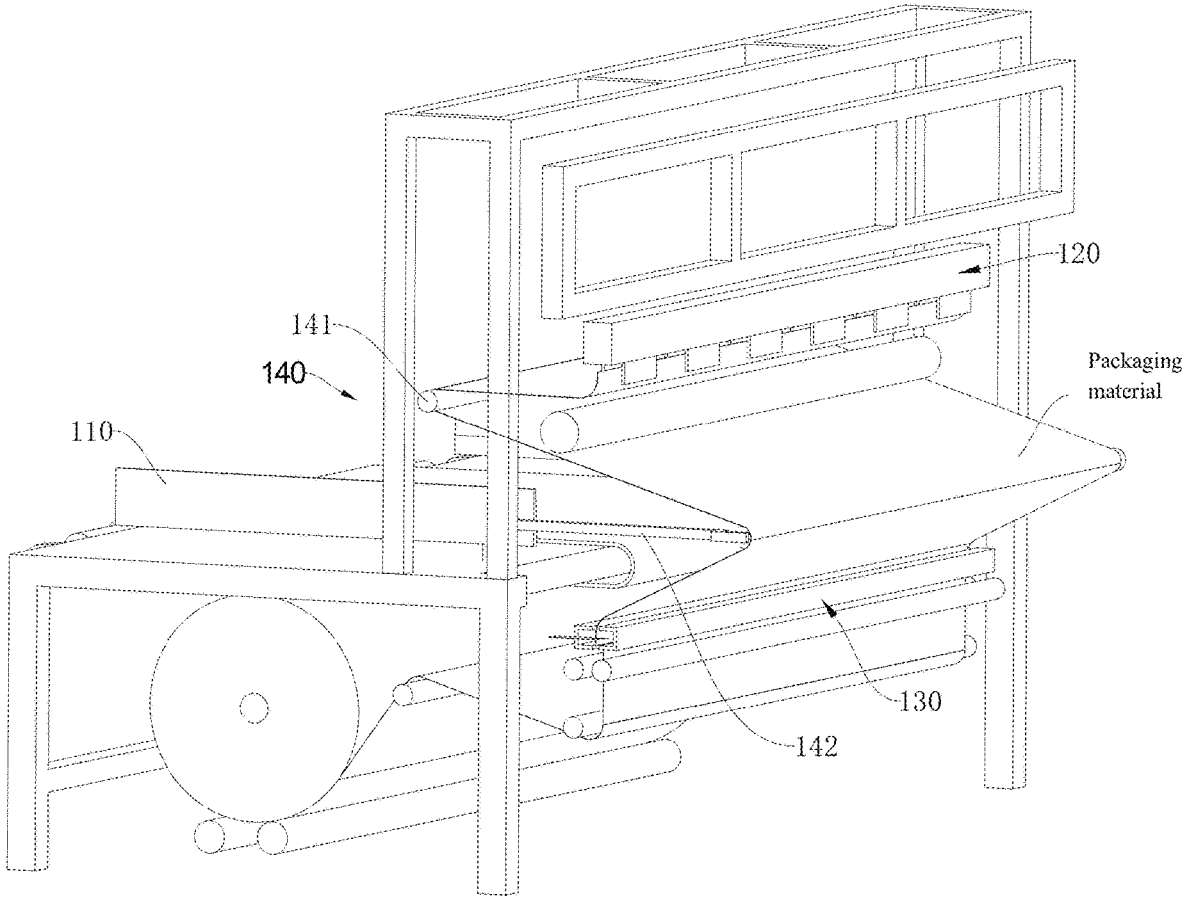
FIG. 3 is a schematic structural diagram of the feeding device according to an embodiment of the present disclosure, where the pre-pulling assembly pushes and pulls the packaging material to make the packaging material form a length matched with that of the mattress in advance.

Referring to FIG. 3, in some embodiments, the feeding device 100 includes a pre-pulling assembly 140 arranged between the pulling assembly 120 and the cutting assembly 130, the pre-pulling assembly 140 includes at least one push-pull member that is movable in a front-back direction to push and pull the packaging material to make the packaging material form a length matched with that of the mattress in advance and reduce the resistance when the mattress is conveyed forward, so that the packaging material is folded in half to wrap the mattress.

In some embodiments, the push-pull member includes a first push-pull member 141 and a second push-pull member 142. The first push-pull member 141 may be a roller shaft, the roller shaft is arranged above the second push-push member 142, and moves backward to pull the packaging material. The second push-pull member 142 is arranged at an inlet of the mattress, and includes two push rods arranged on the left side and the right side and movable forward to push the packaging material. The first push-pull member 141 cooperates with the second push-pull member 142 to enable the packaging material which is vertically arranged to form a concave shape and a length which are matched with those of the mattress, and the mattress is conveyed to pass through the feeding device 100 to be wrapped with the packaging material, and enters the first packaging device 200 and is placed at the first station.

In some other embodiments, one push-pull member may be arranged, only the second push-pull member 142 is arranged, the second push-pull member 142 pushes the packaging material forward to make the packaging material form a length matched with that of the mattress, and the second push-pull member is arranged at an inlet of the mattress, the second push-push member 142 includes two push rods arranged on the left side and the right side and movable forward to push the packaging material, so that the vertically arranged packaging material form a concave shape matched with that of the mattress.

Definitely, it may be understood that more push-pull members may be arranged as required.

It may be understood that in the feeding device 100, the roll of the packaging material may be arranged below the mattress, as shown in FIG. 1; and the roll of raw packaging material may also be arranged above the mattress, as shown in FIG. 5.

Figure 6:
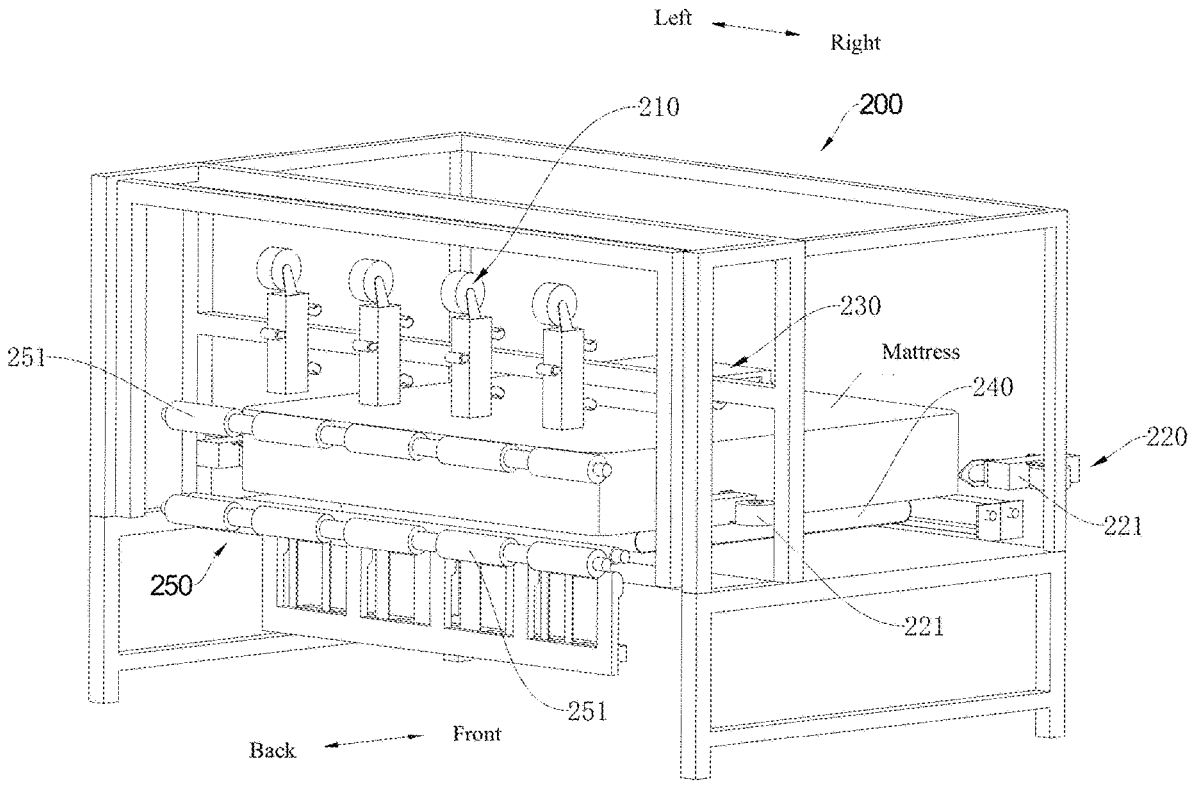
FIG. 6 is a schematic structural diagram of a first packaging device according to an embodiment of the present disclosure.
Figure 7:
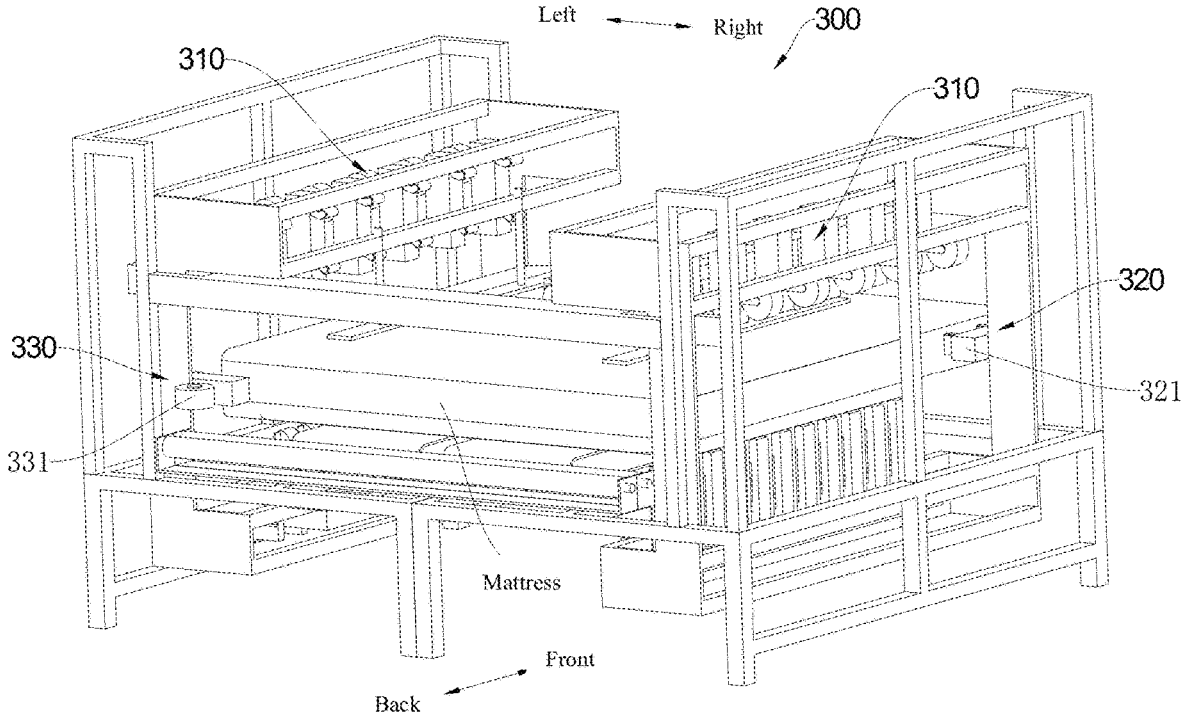
FIG. 7 is a schematic structural diagram of a second packaging device according to an embodiment of the present disclosure.
Figure 8:
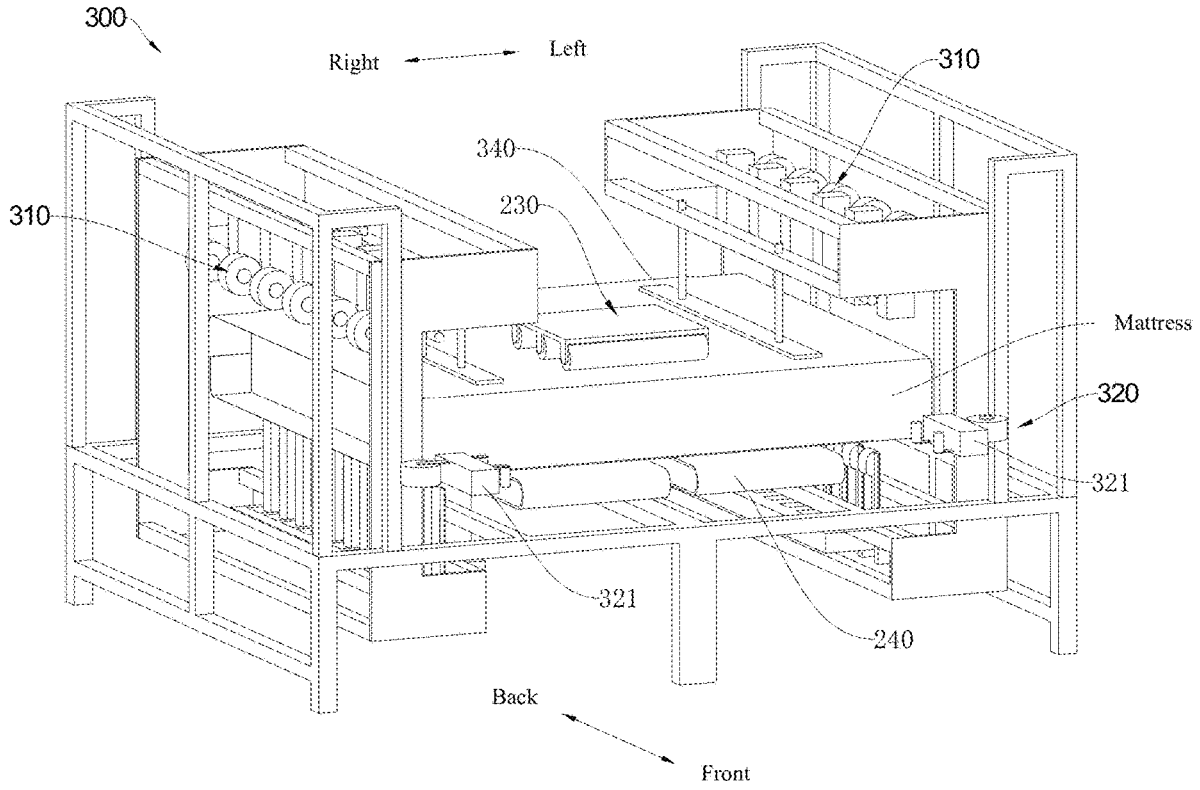
FIG. 8 is a schematic structural diagram of the second packaging device according to an embodiment of the present disclosure from another perspective.

Referring to FIG. 6 to FIG. 8, in some embodiments, a conveying mechanism is arranged on the first station and/or the second station, and includes a first conveying assembly 230 and a second conveying assembly 240 which are oppositely arranged up and down, where the first conveying assembly 230 is configured for pressing the mattress conveyed on the second conveying assembly 240, so that the mattress is more stably conveyed. The mattress moves back and forth or is stationary through conveying by the second conveying assembly 240. Specifically, the first conveying assembly 230 is a roller assembly including a plurality of roller shafts, the roller shafts are mounted on a roller seat, at least one roller shaft is provided with power to drive to other roller shafts, the second conveying assembly 240 is a conveyor belt, and the first conveying assembly 230 may move up and down to adjust the distance between the first conveying assembly 230 and the second conveying assembly and 240 so as to adapt to mattresses with different thicknesses.

Definitely, it may be understood that the second conveying assembly 240 may be movable up and down, or both conveying assemblies may be movable up and down as required, so that the distance between the two conveying assemblies may also be adjusted.

Referring to FIG. 6, further, a conveying roller group 250 is arranged at a rear side of the first station, the conveying roller group 250 includes two groups of conveying rollers 251 which are oppositely arranged up and down, a space for allowing the mattress to pass through is formed between the two groups of conveying rollers 251, the two groups of conveying rollers 251 may move back and forth. When the mattress is moved from the feeding device 100 to the first station, the position of the conveying roller group 250 in the front-back direction is kept fixed, and the mattress is transferred to the first station from the feeding device 100 by rotary conveying. When the mattress is at a predetermined position of the first station (at this time, the end of the mattress will be separated from the conveying roller group 250, while the state of clamping the mattress by the conveying roller group 250 must be kept), the conveying roller group 250 stops rotating and moves to the first station with the mattress, and the mattress is stopped after the mattress is at the first station and the conveying roller group does not interfere with the first folding and vertical sealing mechanism 210. The conveying roller group 250 continues to clamp the mattress to keep the mattress stable, and the first folding and vertical sealing mechanism 210 begins to seal the end of the mattress. When the packaging material at the end of the mattress is vertically sealed, the adhesive tape is pulled for sealing, which causes a push force on the mattress by the adhesive tape. By using the two groups of conveying rollers 251 for clamping and fixing the mattress, the mattress can be prevented from slipping on the second conveying assembly 240. One or both groups of conveying rollers 251 may be adjusted up and down to adapt to mattresses with different thicknesses, and one or both groups of conveying rollers 251 are connected with a power source. When the mattress just enters the first packaging device 200, the power source drives the conveying rollers 251 to convey the mattress in a rotating way, and the power source stops after the mattress reaches a predetermined position. It may be understood that the power source may be a motor which is in direct or indirect transmission connection to one or both groups of the conveying rollers 251.

The packaging material opening at the end of the mattress is folded and vertically sealed by the first folding and vertical sealing mechanism 210, the packaging material on two sides of the mattress are folded and vertically sealed by the second folding and vertical sealing mechanism 310, the first folding and vertical sealing mechanism 210 and the second folding and vertical sealing mechanism 310 have the same structure but different installation positions, the first folding and vertical sealing mechanism 210 is arranged on the rear side of the first station on the first packaging device 200, as shown in FIG. 6. The two second folding and vertical sealing mechanisms 310 are arranged on the left side and the right side of the second station on the second packaging device 300, as shown in FIG. 7 and FIG. 8.

Figure 9:
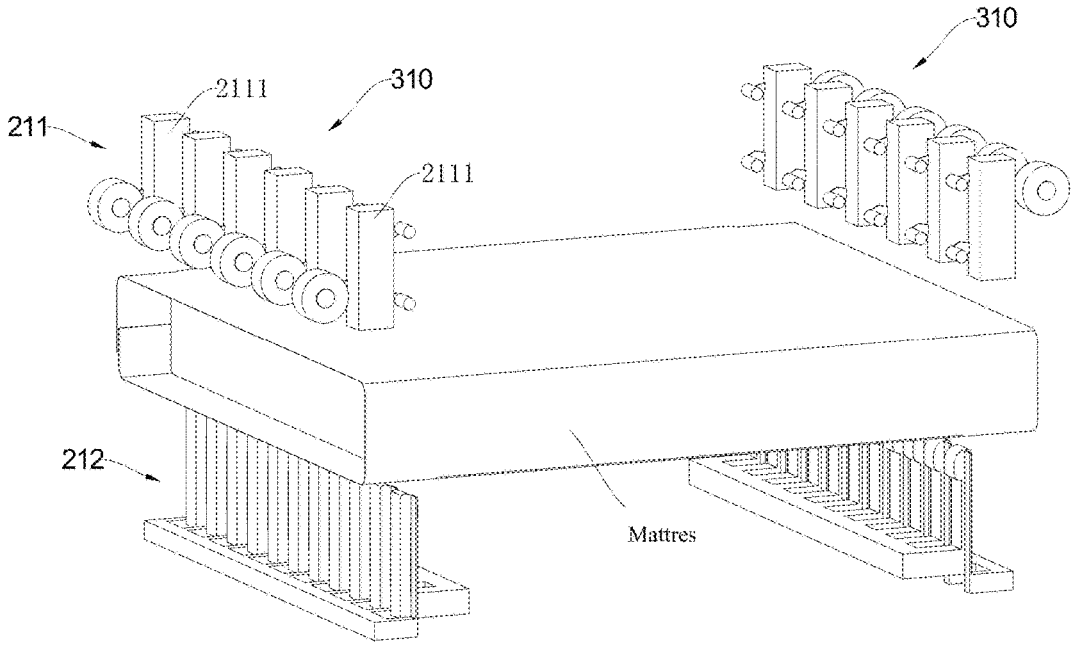
FIG. 9 is a schematic structural diagram of a second folding and vertical sealing mechanism according to an embodiment of the present disclosure.
Figure 10:
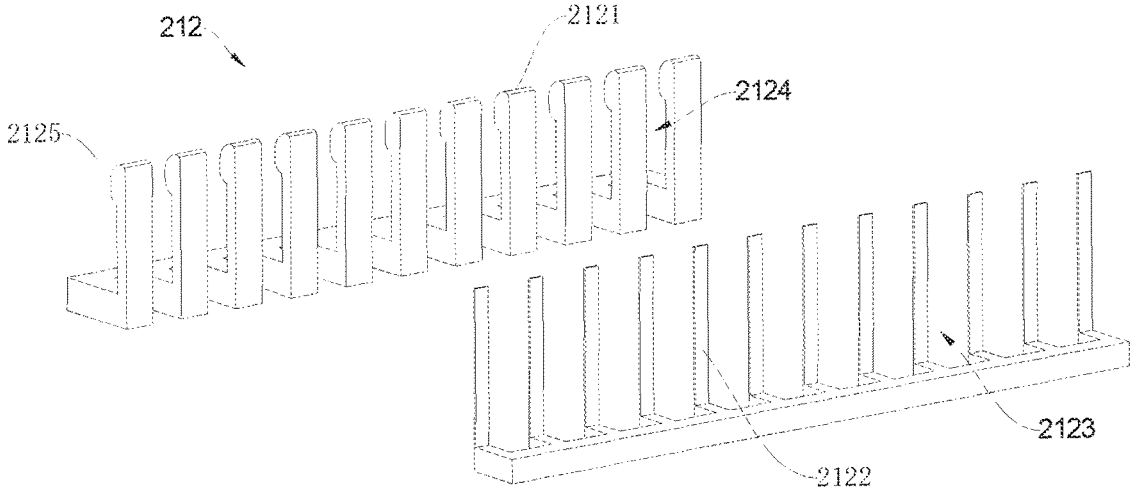
FIG. 10 is a schematic structural diagram of a folding assembly according to an embodiment of the present disclosure.

Referring to FIG. 9 and FIG. 10, in some embodiments, the first folding and vertical sealing mechanism 210 and the second folding and vertical sealing mechanism 310 respectively includes a vertical sealing assembly 211 and a folding assembly 212 which are oppositely arranged up and down, the folding assembly 212 may move up and down to push a lower edge of the packaging material to be folded upwards and attached to the mattress. The vertical sealing assembly 211 includes a plurality of second sealing machines 2111, and the second sealing machines 2111 may move up and down to push the upper edge of the packaging material to be folded downwards and attached to the mattress, and vertically seal the packaging material.

It may be understood that the specific structure of the sealing machine is common knowledge to those of ordinary skill in the art, and the sealing machine performs sealing by pulling the adhesive tape.

It may be understood that the vertical sealing assembly 211 and the folding assembly 212 may exchange their positions, that is, the folding assembly 212 is arranged on the upper side, and the vertical sealing assembly 211 is arranged on the lower side, so that the folding assembly 212 pushes the upper edge of the packaging material to be folded downwards and attached to the mattress, and the vertical sealing assembly 211 pushes the lower edge of the packaging material to be folded upwards and attached to the mattress, and vertically seals the packaging material.

In some embodiments, the folding assembly 212 includes a pushing plate 2121 and a pressing plate 2122, a plurality of first gaps 2123 are formed in the pressing plate 2122 at intervals, a plurality of second gaps 2124 are formed in the pushing plate 2121 at intervals, the first gaps 2123 and the second gaps 2124 are arranged in a staggered manner to form a structure in which the pushing plate 2121 and the pressing plate 2122 may be embedded in each other, the pushing plate 2121 and the pressing plate 2122 may relatively move up and down. The pushing plate 2121 pushes the lower edge or the upper edge of the packaging material to be attached to the mattress, and is reversely separated from the mattress and moves leftward or rightward to the vertical area of the mattress to avoid interference with the second sealing machine 2111. The pressing plate 2122 presses and fixes the position of the upper edge or the lower edge after the lower edge or the upper edge of the packaging material is attached to the mattress, and then the second sealing machine 2111 may perform vertical sealing, and each second sealing machine 2111 is arranged in the vertical direction of each corresponding first gap 2123 of the pressing plate 2122, so as to avoid interference of the vertical movement of the second sealing machine 2111 with the pressing plate 2122. After the vertical sealing is completed, a part of the packaging material wraps the pressing plate 2122. Since the thickness of the pressing plate 2122 is set to be relatively small, the pressing plate may be directly moved up and down to be separated from the packaging material.

Further, a smooth protrusion 2125 is arranged on an inner side of an upper end of the pushing plate 2121 (the side close to the mattress/the first station/the second station), which is convenient to be in contact with the packaging material to push the packaging material to be folded.

In some embodiments, the first folding and vertical sealing mechanism 210 of the first packaging device 200 may move forward and backward, and the two second folding and vertical sealing mechanisms 310 of the second packaging device 300 may relatively move left and right to adjust the distance from the mattress.

After the first folding and vertical sealing mechanism 210 of the first packaging device 200 folds and vertically seals the packaging material opening at the end of the mattress, the two corner sealing mechanisms 220 on the left and right sides complete the folding of the front corner and the rear corner of the packaging material on two sides of the mattress, so that the front corner and the rear corner are attached to the left side and the right side of the mattress and are transversely sealed.

Referring to FIG. 6, in some embodiments, the corner sealing mechanism 220 includes two first sealing machines 221 arranged in front-back direction, the positions of the first sealing machines 221 in the front-back direction are kept fixed. When the conveying assembly conveys the mattress to move forward, the first sealing machine 221 on the front side attaches the front corner of the packaging material to the mattress and seals the front corner, and when the conveying assembly conveys the mattress to move backward and reversely, the first sealing machine 221 on the rear side attaches the rear corner of the packaging material to the mattress and seals the rear corner.

It may be understood that in some other embodiments, as an alternative, the corner sealing mechanism 220 may include only one sealing machine. The corner sealing mechanism 220 includes a first sealing machine 221. When the conveying assembly conveys the mattress to move forward, the first sealing machine 221 attaches the front corner of the packaging material to the mattress and seals the front corner, and when the conveying assembly conveys to move backward and reversely, the first sealing machine 221 attaches the rear corner of the packaging material to the mattress and seals the rear corner. When one sealing machine is used for sealing the front corner and the rear corner on two sides of the mattress, the movement stroke of the mattress in the front-back direction is larger than that of the mattress when two first sealing machines 221 are used.

In some embodiments, the two corner sealing mechanisms 220 on the left side and the right side may relatively move left and right to adjust the distance from the mattress.

It may be understood that the corner sealing mechanism 220 may include only one sealing machine that folds and seals only the front corner or the rear corner.

The packaging material on two sides of the mattress are transversely sealed by the two first transverse sealing mechanisms 320 of the second packaging device 300, and the two first transverse sealing mechanisms 320 are arranged on the left side and the right side of the second station.

Referring to FIG. 7 and FIG. 8, in some embodiments, the first transverse sealing mechanism 320 includes a third sealing machine 321 arranged at the front end. When the conveying assembly conveys the mattress to move forward, the third sealing machine 321 transversely seals the packaging material on the side (left side or right side) of the mattress.

Definitely, it may be understood that the third sealing machine 321 may be arranged at the rear end, so that when the conveying assembly conveys the mattress to move backward, the third sealing machine 321 transversely seals the packaging material on the sides of the mattress.

In some embodiments, the second packaging device 300 further includes a second transverse sealing mechanism 330. The second transverse sealing mechanism 330 is arranged on the rear side of the second station, and includes a fourth sealing machine 331. The fourth sealing machine 331 may move left and right to transversely seal the packaging material at the end of the mattress.

Further, the first transverse sealing mechanism 320 may move left and right to adjust the distance from the mattress, and the second transverse sealing mechanism 330 may move back and forth to adjust the distance from the mattress.

In some embodiments, the second packaging device 300 includes a pressing member 340, the pressing member 340 is arranged above the second station and movable up and down, and the pressing member 340 is configured for pressing the mattress during sealing of the second folding and vertical sealing mechanism 310 and the second transverse sealing mechanism 330, so as to keep the mattress fixed and prevent the mattress from slipping. Specifically, the pressing member 340 includes two pressing plates arranged left and right, the pressing plates are arranged on the second packaging device 300 and slidable up and down, and the pressing plates are driven by a power device to move up and down.

Embodiments of the present disclosure further provide a mattress packaging method for packaging a mattress by the mattress packaging device described above. Referring to FIG. 11 to FIG. 16, the mattress packaging method further includes the following steps.

Figure 11:
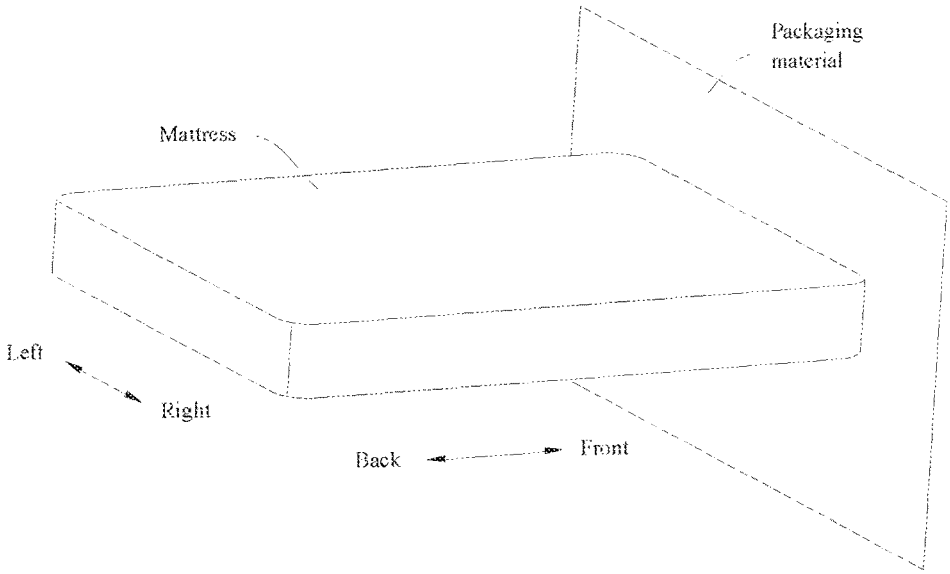
FIG. 11 is a schematic structural diagram of a packaged mattress according to an embodiment of the present disclosure, where the packaging material is vertically placed in front of the mattress.
Figure 12:
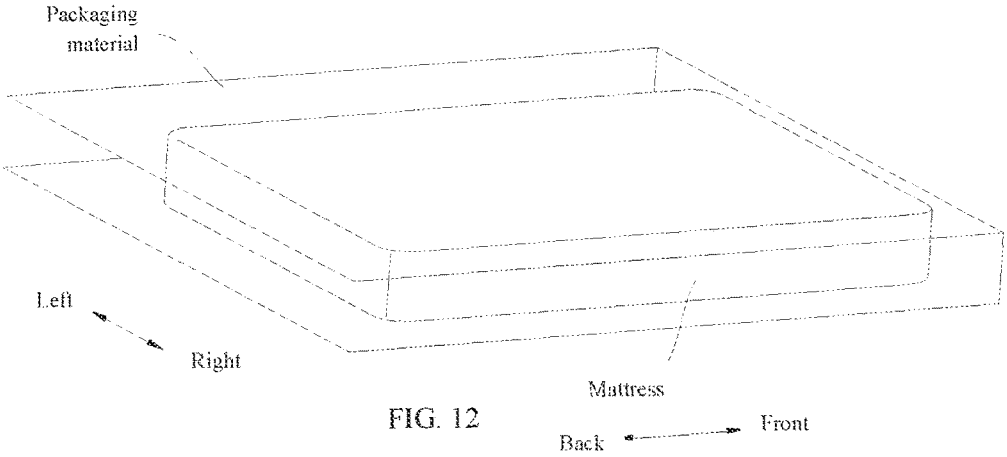
FIG. 12 is a schematic structural diagram of a packaged mattress according to an embodiment of the present disclosure, where the packaging material is folded in half to wrap the mattress.
Figure 13:
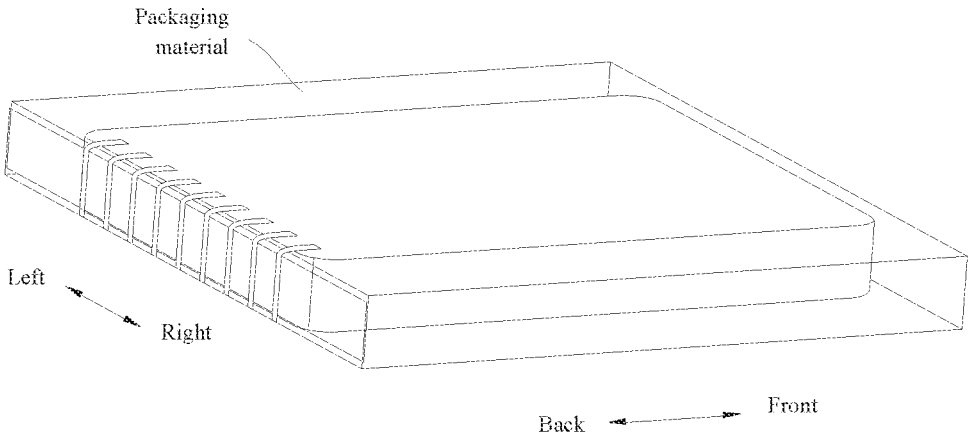
FIG. 13 is a schematic structural diagram of a packaged mattress according to an embodiment of the present disclosure, where the packaging material opening at the end of the mattress is folded and vertically sealed.
Figure 14:
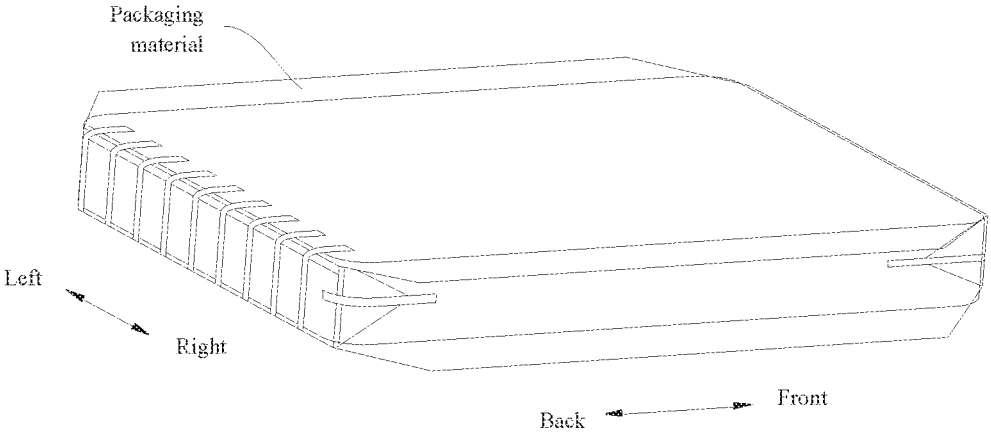
FIG. 14 is a schematic structural diagram of a packaged mattress according to an embodiment of the present disclosure, where front corner and rear corner of packaging material on two sides of the mattress are folded and transversely sealed.
Figure 15:
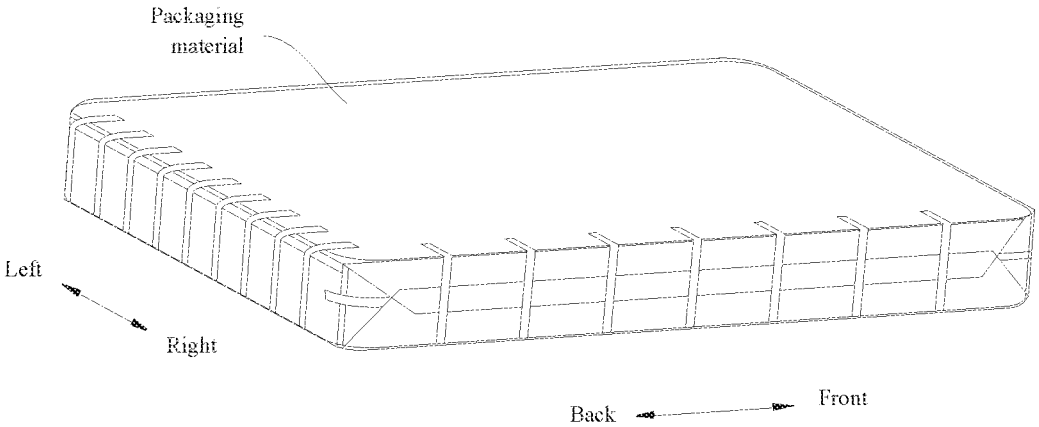
FIG. 15 is a schematic structural diagram of a packaged mattress according to an embodiment of the present disclosure, where packaging material on two sides of the mattress are folded and vertically sealed.
Figure 16:
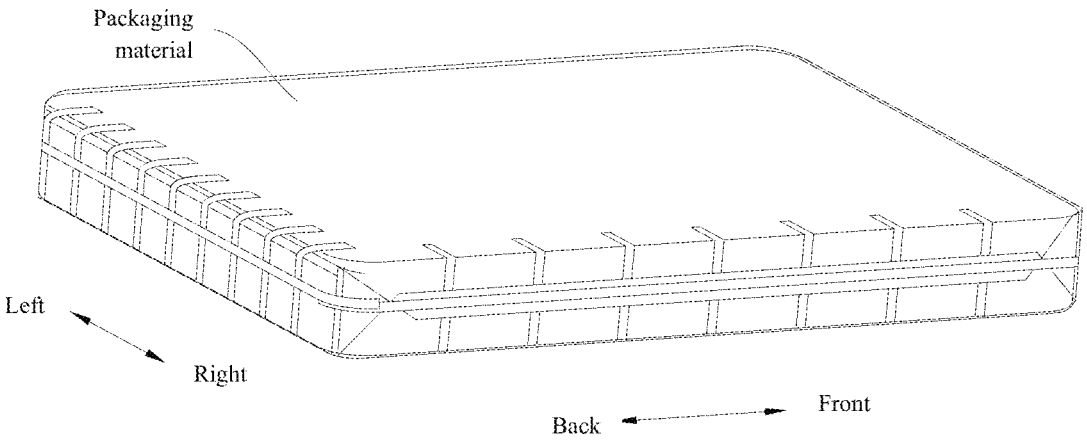
FIG. 16 is a schematic structural diagram of a packaged mattress according to an embodiment of the present disclosure, where packaging material on two sides of the mattress are transversely sealed and the packaging material at the end of the mattress is transversely sealed; and Reference numerals: feeding device 100, positioning member 110, pulling assembly 120, clamping plate 121, cutting assembly 130, clamping member 131, groove 1311, cutter 132, pre-pulling assembly 140, first push-pull member 141, second push-pull member 142, first packaging device 200, first folding and vertical sealing mechanism 210, vertical sealing assembly 211, second sealing machine 2111, folding assembly 212, pushing plate 2121, pressing plate 2122, first gap 2123, second gap 2124, protrusion 2125, corner sealing mechanism 220, first sealing machine 221, first conveying assembly 230, second conveying assembly 240, conveying roller group 250, conveying roller 251, second packaging device 300, second folding and vertical sealing mechanism 310, first transverse sealing mechanism 320, third sealing machine 321, second transverse sealing mechanism 330, fourth sealing machine 331, and pressing member 340.

S100, referring to FIG. 11, the packaging material is vertically placed in front of the mattress by the feeding device 100, wherein the pulling assembly 120 clamps and pulls an upper end of the packaging material, the cutting assembly 130 clamps and cuts the lower end of the packaging material, and the mattress is centered by the two positioning members 110;

S200, referring to FIG. 12, the mattress is conveyed forward, the packaging material is folded in half to wrap the mattress, and margins of the packaging material are reserved respectively at an end, a left side and a right side of the mattress, wherein the margins are less than or equal to the thickness of the mattress, and the packaging material opening is formed at the end of the mattress;

S300, referring to FIG. 13, the mattress is conveyed into the first packaging device 200, and placed on the first station, the mattress is clamped and fixed by the conveying roller group 250, and the packaging material opening at the end of the mattress is folded and vertically sealed by the first folding and vertical sealing mechanism 210;

S400, referring to FIG. 14, when the mattress moves back and forth, the front corner and the rear corner of the packaging material on two sides of the mattress are folded and transversely sealed by the two corner sealing mechanisms 220, specifically, the positions of the two corner sealing mechanisms 220 are kept fixed in the front-back direction, the mattress moves forward to seal the front corner of the packaging material on two sides, and the mattress moves backward to seal the rear corner of the packaging material on two sides;

S500, referring to FIG. 15, the mattress is conveyed into the second packaging device 300, and placed on the second station, the mattress is pressed and fixed by the pressing member 340, and the packaging material on two sides of the mattress are folded and vertically sealed by the two second folding and vertical sealing mechanisms 310;

S600, referring to FIG. 16, the mattress is pressed and fixed by the pressing member 340, and the second transverse sealing mechanism 330 moves left and right to transversely seal the packaging material at the end of the mattress; and S700, referring to FIG. 16, the mattress is released by the pressing member 340, and conveyed to move forward, and the packaging material on two sides of the mattress are transversely sealed by the two first transverse sealing mechanisms 320.

Embodiments of the present disclosure have been described in detail above with reference to the accompanying drawings, but the present disclosure is not limited to the embodiments described above, and various variations may be made within the knowledge of those of ordinary skill in the art without departing from the gist of the present disclosure.

What is claimed is:

1. A mattress packaging device, comprising:

a first packaging device comprising a first folding and vertical sealing mechanism and two corner sealing mechanisms, the first packaging device being provided with a first station for accommodating a mattress, the first folding and vertical sealing mechanism being arranged on a rear side of the first station and configured for folding and vertically sealing a packaging material opening at rear end of the mattress, and the two corner sealing mechanisms being arranged respectively on a left side and a right side of the first station and configured for folding and transversely sealing a front corner and/or a rear corner of packaging material on two sides of the mattress;

a second packaging device comprising two second folding and vertical sealing mechanisms and two first transverse sealing mechanisms, arranged downstream of the first packaging device, and provided with a second station for accommodating the mattress, the two second folding and vertical sealing mechanisms being arranged on a left side and a right side of the second station and configured for folding and vertically sealing the packaging material on two sides of the mattress, and the two first transverse sealing mechanisms being arranged on the left side and the right side of the second station and configured for transversely sealing the packaging material on two sides of the mattress, and a feeding device arranged upstream of the first packaging device, the feeding device being configured for pulling a roll of the packaging material to place the packaging material in front of the mattress, the feeding device comprising a pre-pulling assembly, the pre-pulling assembly comprising a first push-pull member and a second push-pull member, wherein the first push-pull member comprises a roller shaft, the roller shaft is arranged above the second push-push member and moves backward to pull the packaging material; the second push-pull member is arranged at an inlet of the mattress and comprises two push rods arranged on the left side and the right side, and the two push rods move forward to push the packaging material, the first push-pull member cooperates with the second push-pull member to enable the packaging material which is vertically arranged to form a concave shape and a length which are matched with those of the mattress, and the mattress is conveyed to pass through the feeding device to be wrapped with the packaging material, and enters the first packaging device and is placed at the first station;

wherein the first folding and vertical sealing mechanism and the second folding and vertical sealing mechanism both comprise a vertical sealing assembly and a folding assembly which are oppositely arranged up and down, the folding assembly is movable up and down to push a lower edge or an upper edge of the packaging material to be attached to the mattress, and the vertical sealing assembly comprises a plurality of second sealing machines, and is movable up and down to push the upper edge or the lower edge of the packaging material to be attached to the mattress and vertically seal the packaging material;

wherein the folding assembly comprises a pushing plate and a pressing plate, a plurality of first gaps are formed in the pressing plate at intervals, a plurality of second gaps are formed in the pushing plate at intervals, the first gaps and the second gaps are arranged in a staggered manner to form a structure in which the pushing plate and the pressing plate are able to be embedded into each other, the pushing plate and the pressing plate are movable up and down relative to each other, the pushing plate is configured for pushing the upper edge or the lower edge of the packaging material to be attached to the mattress and then being separated from the mattress, the pressing plate is configured for fixing positions of the upper edge or the lower edge after the upper edge or the lower edge of the packaging material is attached to the mattress, and the second sealing machines are arranged in a vertical direction of the first gaps;

wherein a direction front refers to a direction of a conveyance of the mattress, a direction rear is an opposite direction to the direction of the conveyance of the mattress, directions left, right, up and down are based on the direction of the conveyance of the mattress, a direction transverse refers to a direction parallel to the direction of the conveyance of the mattress, and a direction vertical refers to a direction vertical in the direction of the conveyance of the mattress.

2. The mattress packaging device according to claim 1, wherein a conveying mechanism is arranged on the first station and/or the second station, and comprises a first conveying assembly and a second conveying assembly which are oppositely arranged up and down, the first conveying assembly is configured for pressing the mattress conveyed on the second conveying assembly.

3. The mattress packaging device according to claim 2, wherein the first conveying assembly and/or the second conveying assembly is movable up and down to adjust a distance between the first conveying assembly and the second conveying assembly.

4. The mattress packaging device according to claim 2, wherein a conveying roller group is arranged on the rear side of the first station, and comprises two groups of conveying rollers which are oppositely arranged up and down, a space for the mattress to pass through is formed between the two groups of conveying rollers, and the two groups of conveying rollers are configured for clamping the mattress after the mattress moves forward to a predetermined position.

5. The mattress packaging device according to claim 4, wherein one or two groups of the conveying rollers is movable up and down, and one or two groups of the conveying rollers are connected with a power source.

6. The mattress packaging device according to claim 1, wherein the corner sealing mechanism comprises two first sealing machine arranged in a front-back direction, the first sealing machine on a front side is configured for attaching the front corner of the packaging material to the mattress when the mattress moves forward and sealing the front corner, and the first sealing machine on a rear side is configured for attaching the rear corner of the packaging material to the mattress when the mattress moves backward reversely and sealing the rear corner.

7. The mattress packaging device according to claim 1, wherein the corner sealing mechanism comprises a first sealing machine for attaching the front corner of the packaging material to the mattress when the mattress moves forward and sealing the front corner, and for attaching the rear corner of the packaging material to the mattress when the mattress moves backward reversely and sealing the rear corner.

8. The mattress packaging device according to claim 1, wherein a smooth protrusion for contact with the mattress is arranged on one side of an upper end of the pushing plate.

9. The mattress packaging device according to claim 1, wherein the first transverse sealing mechanism comprises a third sealing machine configured for transversely sealing the packaging material on two sides of the mattress when the mattress moves forward.

10. The mattress packaging device according to claim 1, wherein the second packaging device further comprises a second transverse sealing mechanism, the second transverse sealing mechanism is arranged on a rear side of the second station and comprises a fourth sealing machine movable left and right to transversely seal the packaging material at an end of the mattress.

11. The mattress packaging device according to claim 1, wherein the second packaging device comprises a pressing member, the pressing member is arranged on a left side and a right side above the second station and movable up and down, and the pressing member is configured for pressing the mattress to keep the mattress fixed.

12. The mattress packaging device according to claim 1, wherein the feeding device comprises two positioning members which are oppositely arranged, the two positioning members are movable in opposite directions to place the mattress at a centered position, and an induction assembly for detecting a left-right width of the mattress is installed on each positioning member.

13. The mattress packaging device according to claim 1, wherein the feeding device comprises a pulling assembly and a cutting assembly which are oppositely arranged up and down, the pulling assembly is movable up and down and configured for clamping and pulling the packaging material to vertically place the packaging material in front of the mattress, and the cutting assembly is configured for clamping and cutting the packaging material.

14. The mattress packaging device according to claim 13, wherein the cutting assembly comprises a cutter and two clamping members capable of clamping relative to each other, the two clamping members each define a groove opposite to each other, and a space for the cutter to move and cut the packaging material is formed between the grooves of the two clamping members.

15. A mattress packaging method for packaging a mattress using the mattress packaging device according to claim 1, comprising:

placing a packaging material in front of the mattress;

moving the mattress forward to enable the packaging material to wrap the mattress, wherein a packaging material opening is formed at rear end of the mattress;

conveying the mattress into the first packaging device, placing the mattress on the first station, and folding and vertically sealing the packaging material opening at the rear end of the mattress by the first folding and vertical sealing mechanism;

folding and transversely sealing the front corner and the rear corner of the packaging material on two sides of the mattress by the two corner sealing mechanisms;

conveying the mattress into the second packaging device, placing the mattress on the second station, and folding and vertically sealing the packaging material on two sides of the mattress by the second folding and vertical sealing mechanism;

sealing the packaging material at the end of the mattress from a left side to a right side of the mattress or from the right side to the left side of the mattress; and transversely sealing the packaging material on two sides of the mattress by the two first transverse sealing mechanisms;

wherein a direction front refers to a direction of a conveyance of the mattress, a direction rear is an opposite direction to the direction of the conveyance of the mattress, directions left, right, up and down are based on the direction of the conveyance of the mattress, a direction transverse refers to a direction parallel to the direction of the conveyance of the mattress, and a direction vertical refers to a direction vertical in the direction of the conveyance of the mattress.

16. The mattress packaging method according to claim 15, wherein margins of the packaging material are reserved respectively at the end, and the left side and the right side of the mattress, and the margins are less than or equal to a thickness of the mattress.

17. The mattress packaging method according to claim 15, wherein the positions of the two corner sealing mechanisms are kept fixed in the front and back direction, the mattress moves forward to seal the front corner materials of the packaging materials on two sides, and the mattress moves backward to seal the rear corner materials of the packaging materials on two sides.

18. The mattress packaging method according to claim 15, wherein the position of the first transverse sealing mechanism is kept fixed in the front and back direction, and the mattress moves forward to transversely seal the two sides of the mattress.

* * * * *